US005206895A

United States Patent [19]

Danos

[11] Patent Number: 5,206,895

[45] **Date of Patent: * Apr. 27, 1993**

[54] X-RAY TUBE

[76] Inventor: Michael Danos, 7525 Spring Lake Dr., Bethesda, Md. 20817

[ * ] Notice: The portion of the term of this patent subsequent to Jul. 7, 2009 has been disclaimed.

[21] Appl. No.: 794,504

[22] Filed: Nov. 19, 1991

Related U.S. Application Data

[63] Continuation of Ser. No. 571,705, Aug. 24, 1990, Pat. No. 5,128,977.

[51] Int. Cl.[5] ..... H01J 35/02

[52] U.S. Cl. ..... 378/121; 378/125; 378/127; 378/140; 378/143

[58] Field of Search ..... 378/121, 124, 125, 127, 378/136, 137, 138, 140, 143

[56] References Cited

U.S. PATENT DOCUMENTS

| | | | |
|---|---|---|---|
| 3,719,846 | 3/1973 | Berend et al. | 378/121 |
| 4,392,235 | 7/1983 | Houston | 378/10 |
| 5,029,195 | 7/1991 | Danos | 378/121 |
| 5,128,977 | 7/1992 | Danos | 378/121 |

OTHER PUBLICATIONS

M. J. Berger, "Note Carlo Calculations of the Penetration and Diffusion of Fast Charged Particles", in *Methods of Computational Physics,* vol. 1, ed. by B. Adler, S. Fernbach and M. Rotenberg (Academic Press, New York, 1963).

S. M. Seltzer, "An Overview of ETRAN Monte Carlo Methods", pp. 153-181 in *Monte Carlo Transport of Electrons and Photons*, ed. by Thomas M. Jenkins, W. R Nelson and A. Rindi (Plenum Press, New York 1988).

M. J. Berger, "Etran-Experimental Benchmarks", pp. 183-219, ibidem.

J. Halbleib, "Applications of the ITS Codes", pp. 263-284, ibidem.

S. M. Seltzer and M. J. Berger, "Bremsstrahlung Spectra from Electron Interactions with Screened Atomic Nuclei and Orbital Electrons", Nucl. Instr. Meth. B12, 95 (19850; and "Bremsstrahlung Energy Spectra from Electrons with Kinetic Energy 1 keV-100 GeV Incident on Screened Nuclei and Orbital Electrons of Neutral Atoms with Z-1-100", Atom. and Nuclear Data Tables 35, 345 (1986).

Instr. Meth. B12, 95 (19850; and "Bremsstrahlung Energy Spectra from Electrons with Kinetic Energy 1 keV-100 GeV Incident on Screened Nuclei and Orbital Electrons of Neutral Atoms with Z-1-100", Atom. and Nuclear Data Tables 35, 345 (1986).

M. J. Berger and J. H. Hubbell, "XCOM: Photon Cross Sections on a Personal Computer", National Bureau of Standards Report NBSIR 87-3597 (1987).

*Primary Examiner*—David P. Porta

*Attorney, Agent, or Firm*—Howard L. Rose

[57] ABSTRACT

An X-ray tube for greatly enhancing the output of photons relative to a standard tube includes a source of an electron beam focused on a target at an angle of approximately 10° to produce high energy photons emitted at an angle along their centerline of 5° to 15°, both angles referring to the surface of the target. Reduction of impurgement of scattered electrons on the tube window is affected in various ways such as use of a magnet to deflect electrons from the photon stream or locating the window out of alignment with the most intense scattered electrons. Scattered electrons are also absorbed by an essentially zero albedo shield disposed in the path of the majority of the scattered electrons not directed at the window.

30 Claims, 6 Drawing Sheets

X-RAY TUBE

This is a continuation of application Ser. No. 07/571,705 filed Aug. 24, 1990 now U.S. Pat. No. 5,128,977.

BACKGROUND OF THE INVENTION

The present invention relates to X-ray tubes and more particularly to a method and construction of an X-ray tube for producing X-rays over a specified range of emission angles with enhanced power output and high duty cycle.

The maximum X-ray power output from an X-ray tube is an important parameter in the operation and maintenance of a radiological system. The time period required to inspect an object is inversely proportional to the X-ray power output. In addition, for a given X-ray power output of the X-ray tube, tube lifetime increases substantially as its maximum power rating increases. Accordingly, the effect of using X-ray tubes with higher values for the maximum X-ray power output than presently available, is to reduce the inspection times and increase the throughput of patients or objects examined with the radiological system, as well as to reduce the maintenance and operating costs because of the longer tube lifetimes.

In X-ray tubes in current use, a beam of high energy electrons is directed at about 80° to 90° at an X-ray producing target with an incident angle with respect to the target surface in the region between 70° and 90° (most commonly at 80°).

BRIEF DESCRIPTION OF THE PRESENT INVENTION

In accordance with the present invention, it has been found that for a given target heat load, focal spot size, kilovoltage, and X-ray emission solid angle at approximately 10° with respect to the target surface (as used in present day X-ray tubes), the X-ray emission power increases to a maximum value as the incident electron angle with respect to the target surface decreases from approximately 80° (as used in present day tubes) to approximately 10°. This power enhancement factor given by the ratio of the emission power at 10° to that at 80° increases with kilovoltage from an approximate value of 1.4 at 50 kilovolts to 2.4 at 500 kilovolts. In addition, it has been found that the X-ray continuum spectrum becomes "harder" as the incident electron angle decreases from 80° to 10° such that the relative X-ray intensities in the high energy region near the upper limit of the bremsstrahlung spectrum are much larger for an incident angle of 10° compared to 80°. Further an overall tube geometry and electron gun design is provided which produces a maximum X-ray emission power for the same focal spot sizes and X-ray emission angles as used in present-day X-ray tubes.

Specifically the present invention relates the output angle $\Theta$ of the X-rays to the input angle $\alpha$ of the electrons both relative to the surface of the target to provide the maximum X-ray emission power for a given heat load on the target. It has been found that the above desired effect is achieved where both of the angles $\alpha$ and $\Theta$ are at about $10° \pm 3°$.

Consideration must be given to the effect of scattered electrons on the windows. If the window is in direct line with the highest intensity electrons scattered from the target, then heavy concentrations of scattered electrons may strike the window and destroy it. There are several solutions to this problem such as locating the window out of line with the scattered electron beam; deflecting the electrons out of the path to the window; or locating the window at an azimuthal angle of preferably 10° or more which avoids the maximum intensity of the scattered electrons at the given X-ray emission angle of 10° and yet provides approximately the same X-ray emission power.

The electrons may be deflected out of the desired photon path by a magnet if the distance between the electron beam target and the window is sufficient to accommodate the magnet and an electron absorber. If this is not possible then the window is located at an azimuthal angle (angle $\phi$) that is not in line with the electron beam. The concentration of electron falls dramatically at 5° to 10° out of alignment, i.e. an angle $\phi = 10°$.

Regardless of the approach employed to eliminate impingement of a maximum concentration of electrons on the window, an electron capture trap of suitable material, copper for instance, is employed to absorb a large proportion of these electrons. Otherwise the electrons will be reflected back onto the target and increase heating by as much as an estimated 10% or more. In the present invention, the electron capture trap is designated as a zero albedo electron trap, and it is claimed that such a trap is obtained with a saw-tooth configuration of copper or low Z material at the same or slightly more positive electric potential as the anode.

The above designs and configurations for the electron gun, anode, and zero albedo electron trap may be used in any type of X-ray tube employing a stationary or rotating anode and operating in the region from 20 to 500 kilovolts. The data required to determine the optimum tube geometry for maximum X-ray power output were obtained from detailed Monte Carlo calculations of the electron energy albedo in a tungsten target. These calculations included a detailed account of the electron scattering, penetration, and energy losses in the target for specified incident electron energies, as well as a quantitative description of the energy and angular distribution of the accompanying X-rays.

OBJECTS OF THE INVENTION

It is an object of the present invention to provide a method and structure for producing maximum X-ray emission power from an X-ray tube for a given heat load on the X-ray producing target at a given tube voltage.

It is another object of the present invention to provide an X-ray tube geometry for producing a maximum X-ray emission power for a given heat load on the target.

It is yet another object of the present invention to provide an optimum X-ray tube geometry for producing the maximum X-ray power output for X-ray tubes that can operate in the 50 to 500 kilovolt range.

It is still another object of the present invention to provide a sealed rotating anode tube having X-ray emission power of 1.4, 1.6 and 2.0 times the power of present day conventional X-ray tubes operating at 50, 150 and 300 kilovolts, respectively.

Still another object of the invention is to avoid damage of the X-ray window by scattered electrons.

Another object of the invention is to avoid heating of the anode or minimize off-focus radiation by back-scattered electrons, by introducing a novel zero-albedo electron trap.

Yet another object of the present invention is to produce an X-ray spectrum that has a much higher intensity in the high energy region compared to the spectrum produced by a standard X-ray tube, both without the us of filters.

DETAILED DESCRIPTION OF THE PRESENT INVENTION

Figure 1:
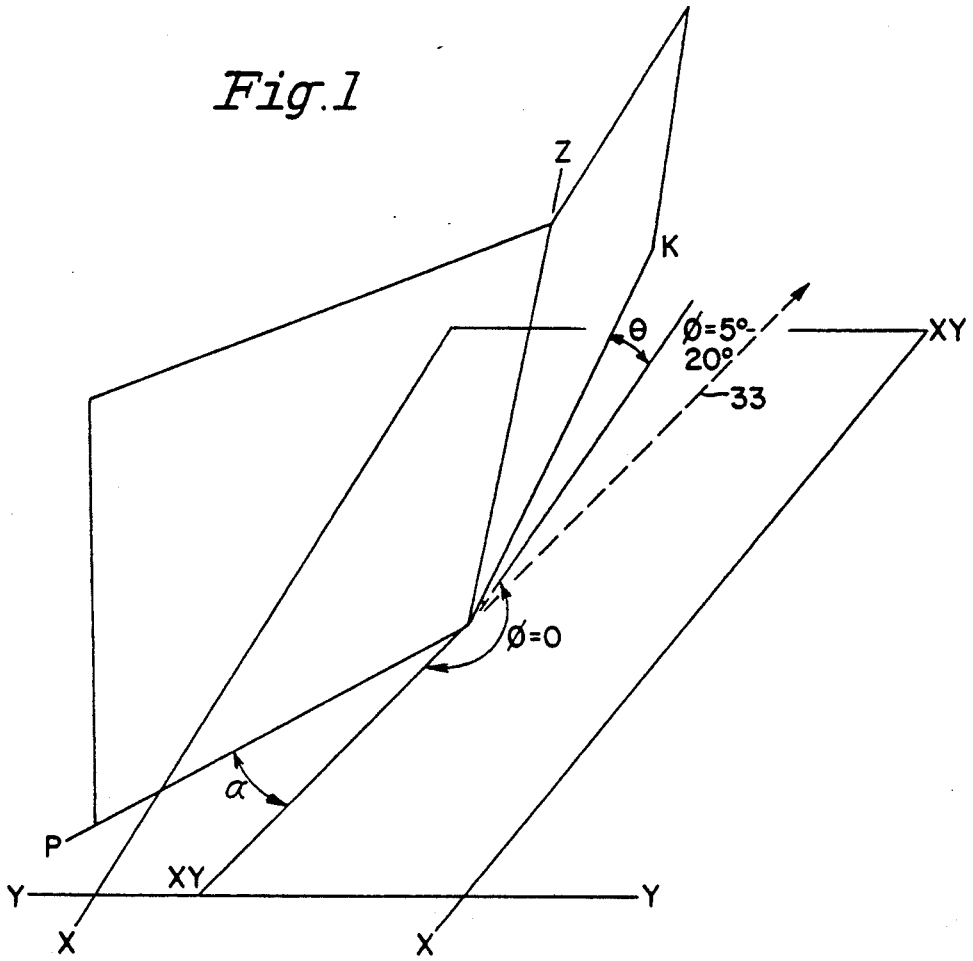
FIG. 1 is a diagram illustrating the target plane and the vectors of the incident electron beam and the path of X-ray emissions relative to the target plane.

Referring specifically to FIG. 1 of the accompanying drawings there is illustrated the relationship between the incident electron beam, the X-ray emitting target and the X-ray emissions.

The electron beam is incident on a tungsten target, the x-y plane, such that $\alpha$ is the incident angle (also designated as the obliquity angle) of the electron momentum vector, p, with respect to the plane of the target surface. The incident plane is defined by the two vectors (p, z) where z is the normal vector to the target plane. The X-ray emission angle, $\Theta$, is defined as the angle between the photon momentum vector, k, and the plane of the target surface, and the emission plane is defined by the two vectors (k, z). The calculations also include the third directional parameter, namely the azimuthal angle, $\phi$, between the incident and emission planes as shown in FIG. 1. More specifically the angle $\phi$ can be considered to be the angle between the projections of p and k on the XY plane.

The production of X-rays in a tungsten target, and the penetration and diffusion of the X-rays and electrons in this target, are calculated by the Monte Carlo method, using the electron-photon transport code ETRAN. In regard to photon transport, this code uses a conventional Monte Carlo model in which all successive photon scatterings are sampled. In regard to electron transport ETRAN is based on a condensed-random walk model, [M. J. Berger, "Monte Carlo Calculations of the Penetration and Diffusion of Fast Charged Particles", in *Methods of Computational Physics*, Vol. *1*, ed. by B. Alder, S. Fernbach and M. Rotenberg (Academic Press, New York 1963)], in which angular deflections and energy losses of electrons in successive short path segments are sampled from appropriate distributions given by multiple-scattering and straggling theories. An overview of the ETRAN code can be found in S. M. Seltzer, "An Overview of ETRAN Monte Carlo Methods", pp 153–181 in *Monte Carlo Transport of Electrons and Photons*, ed. by Thomas M. Jenkins, W. R. Nelson and A. Rindi (Plenum Press, New York 1988). The reliability and capabilities of ETRAN are discussed in M. J. Berger, "Etran—Experimental Benchmarks", pp 183–219, ibidem, and also in J. Halbleib, "Applications of the ITS Codes", pp 263–284, ibidem. where a series of transport programs are discussed which borrow the Monte Carlo model from ETRAN but treat more complex source-target configurations. The X-ray production cross sections used in ETRAN are described in S. M. Seltzer and M. J. Berger, "Bremsstrahlung Spectra from Electron Interactions with Screened Atomic Nuclei and Orbital Electrons", Nucl. Instr. Meth. B12, 95 (1985); and "Bremsstrahlung Energy Spectra from Electrons with Kinetic Energy 1 keV—100 GeV Incident on Screened Nuclei and Orbital Electrons of Neutral Atoms with Z=1–100", Atom, and Nuclear Data Tables 35, 345 (1986), and the photon scattering and absorption cross sections in M. J. Berger and J. H. Hubbell, "XCOM: Photon Cross Sections on a Personal Computer", National Bureau of Standards Report NBSIR 87-3597 (1987). In addition to the X-rays produced when electrons are slowed down in the field of atoms and atomic electrons, the calculations also take into account the characteristic X-rays produced when electrons are ejected from the K shell of tungsten. Characteristic X-rays from the L-shell and the remaining shells are neglected.

Each electron's Monte Carlo history is followed until the electron's energy falls below 10 keV. The histories of secondary X-rays and characteristic X-ray photons are also followed down to 10 keV. For each combination of initial electron energy and direction of incidence, a sample of 100,000 electron histories is followed, and samples of 10 million histories of X-rays and 10 million histories of characteristic X-rays. The results are adjusted by means of a weight factor (much smaller than unity) to take into account the natural rate of photon production.

Figure 2:
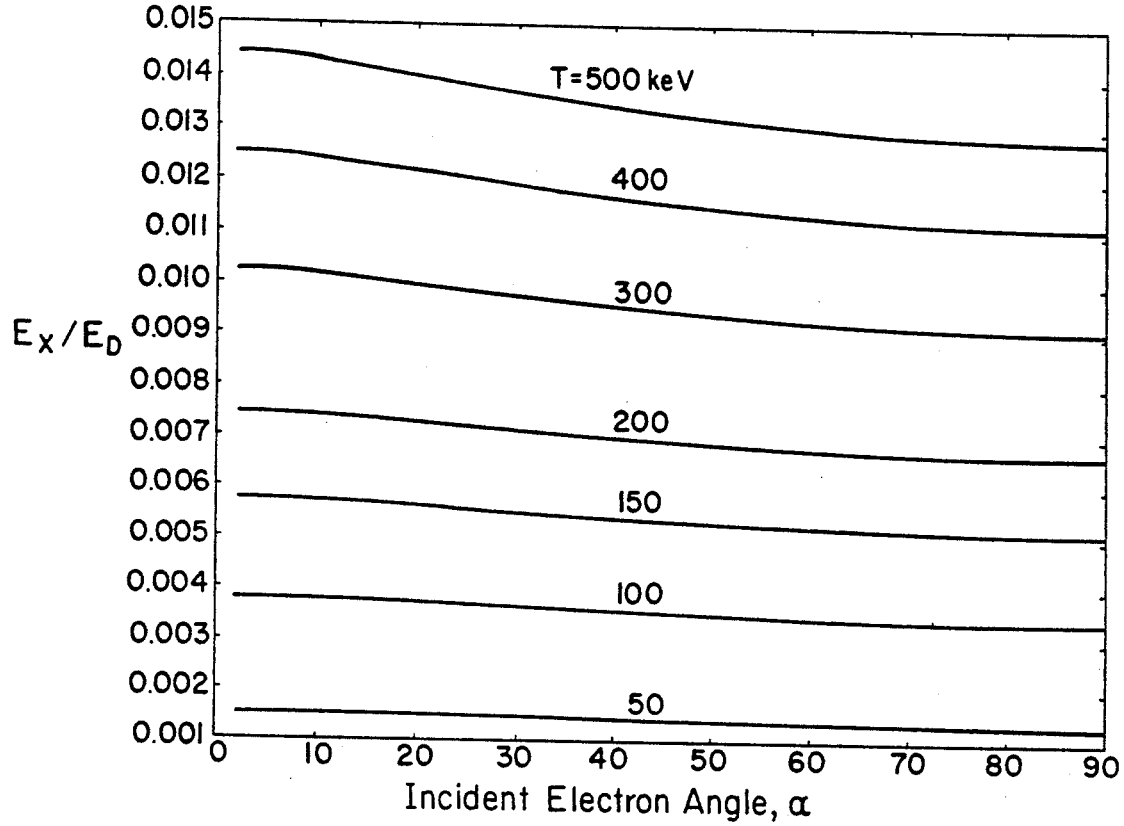
FIG. 2 is a plot of the ratio of X-ray emission energy to electron deposition energy as a function of electron beam angle to the target plane.

Referring now to FIG. 2 of the accompanying drawings $E_X/E_D$ is plotted as a function of the electron beam angle $\alpha$ for incident electron energies of 50, 100, 150, 200, 300, 400 and 500 keV. The term $E_X$ is the total photon energy emitted from the target for a given incident electron beam energy ($E_T$) using a minimum cutoff photon energy of 10 keV ($k_C$). $E_D$ is electron energy deposited in the target for a given $E_T$. It is noted from FIG. 2 that in all instances at an angle of 10° the factor $E_X/E_D$ is very near its maximum. This fact clearly indicates that the total X-ray emission energy per unit electron energy as a function of the angle $\alpha$ decreases with increasing angle $\alpha$.

Another important parameter in defining a final tube geometry is the ratio of $E_X(\Theta)/E_D$ as a function of the angle $\alpha$. The factor $E_X(\Theta)$ is the angular distribution of photon energy emitted as a function of angle $\Theta$ averaged over 5° intervals and angle $\phi$ averaged over the angle −10° to +10°. The energy is integrated over k from $k_C$ to T per unit solid angle per incident electron for a given T and $\alpha$. The factor T is the incident electron kinetic energy, k is the photon energy and $k_C$ is as stated above.

Figure 3:
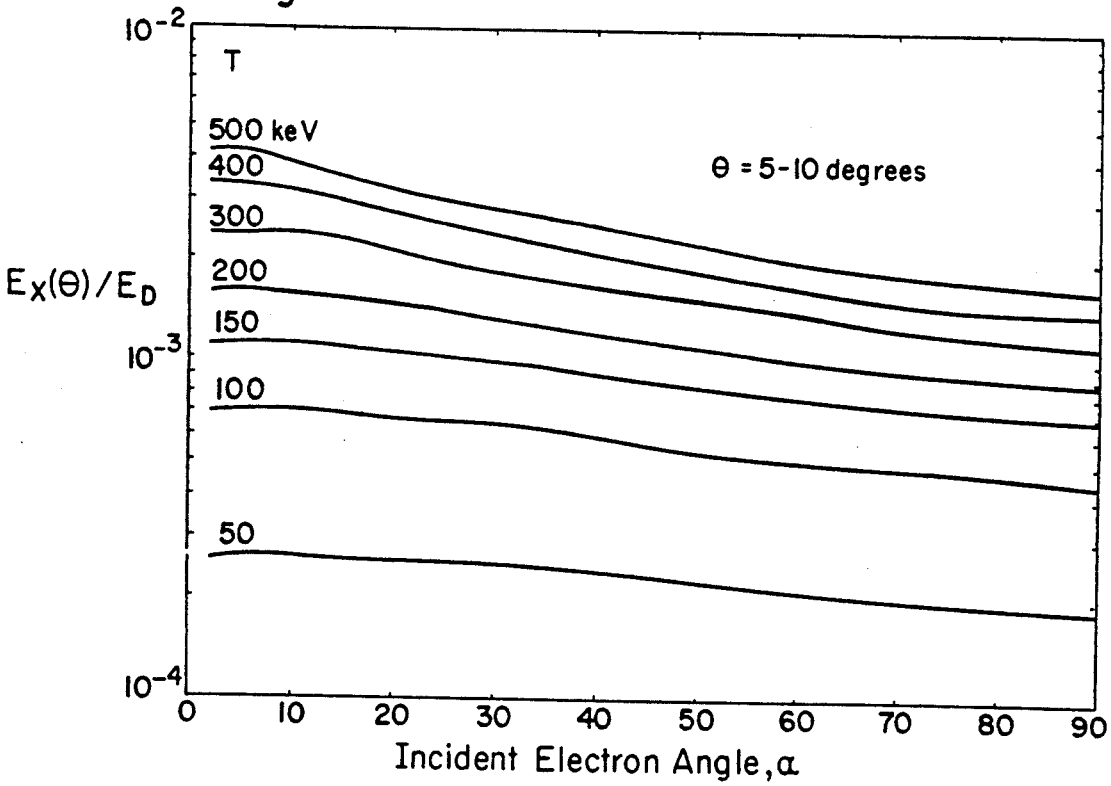
FIG. 3 is a plot of the ratio of X-ray emission energy per unit solid angle at X-ray emission angles 5 to 10°, to electron deposition energy as a function of electron beam angle $\alpha$ to the target plane.

The results presented in FIG. 3 a plot of $E_X(\Theta)/E_D$ vs. angle $\alpha$ show that the maximum X-ray emission energy per unit of electron deposition energy in the target is produced for an angle u of approximately 10°. In consequence the degree of heating per unit of X-ray emission energy is at a minimum at $\alpha=10°\pm3°$.

Figure 4:
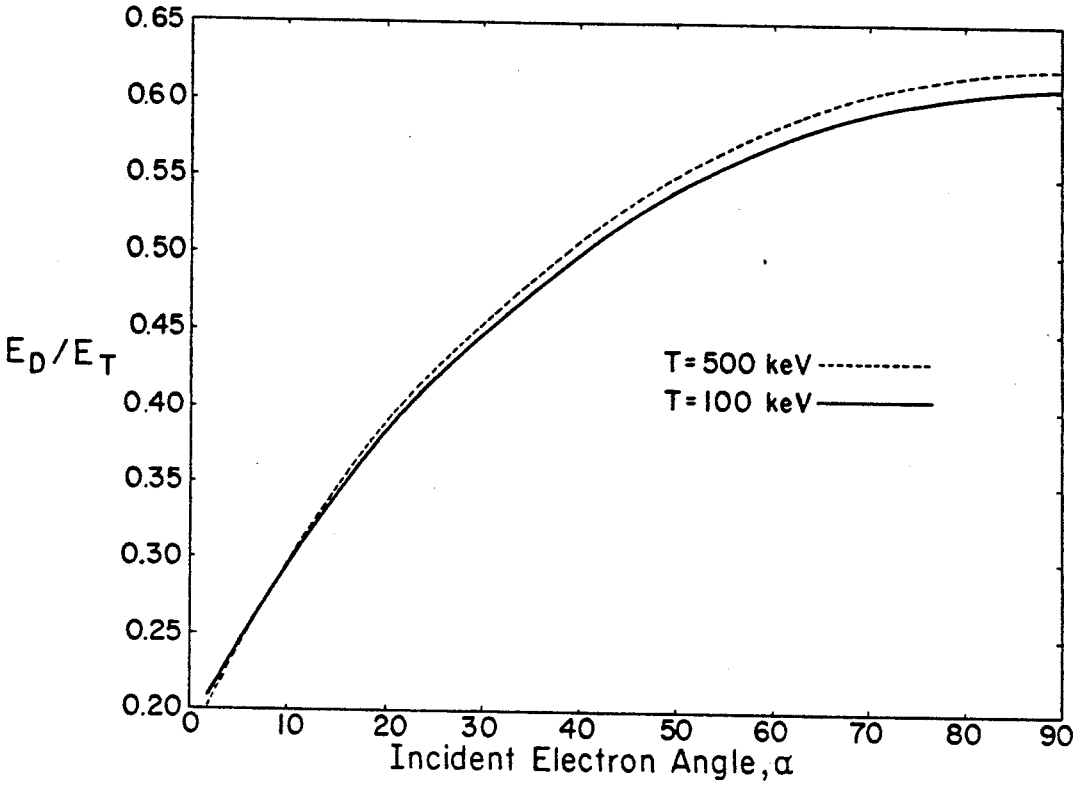
FIG. 4 is a plot of the electron deposition energy to the incident electron beam energy as a function of electron beam angle $\alpha$ to the target plane.

The above statement is further borne out by the curves of FIG. 4 which are a plot of the electron energy deposited in the target per unit of electron energy, $E_D/E_T$, as a function of the angle $\alpha$ for electron beams of 100 keV and 500 keV.

The power enhancement factor of the newly invented tube is based on the following equations:

$$r_{EP}=[E_X(\Theta=10°)/E_D]\alpha=10° \text{ and} \quad (1)$$

$$r_S=[E_X(\Theta=10°)/E_D]\alpha=80° \quad (2)$$

where $r_{EP}$ is the energy ratio for the tube of the present invention and $r_S$ is the energy ratio for the tube of the prior art. The power enhancement then is $r_{EP}/r_S$ or $$P=[E_X(\Theta=10°)]_{EP}/[E_X(\Theta=10°)]_S. \quad (3)$$

It is apparent that the energy deposited in the target; that is, the electron beam energy that contributes to heating, is far lower at $\alpha=10°$ than the larger values of $\alpha$. The ratio $E_D/E_T$ is in the region of 0.60 at 80° as opposed to approximately 0.29 at 10°.

Figure 5:
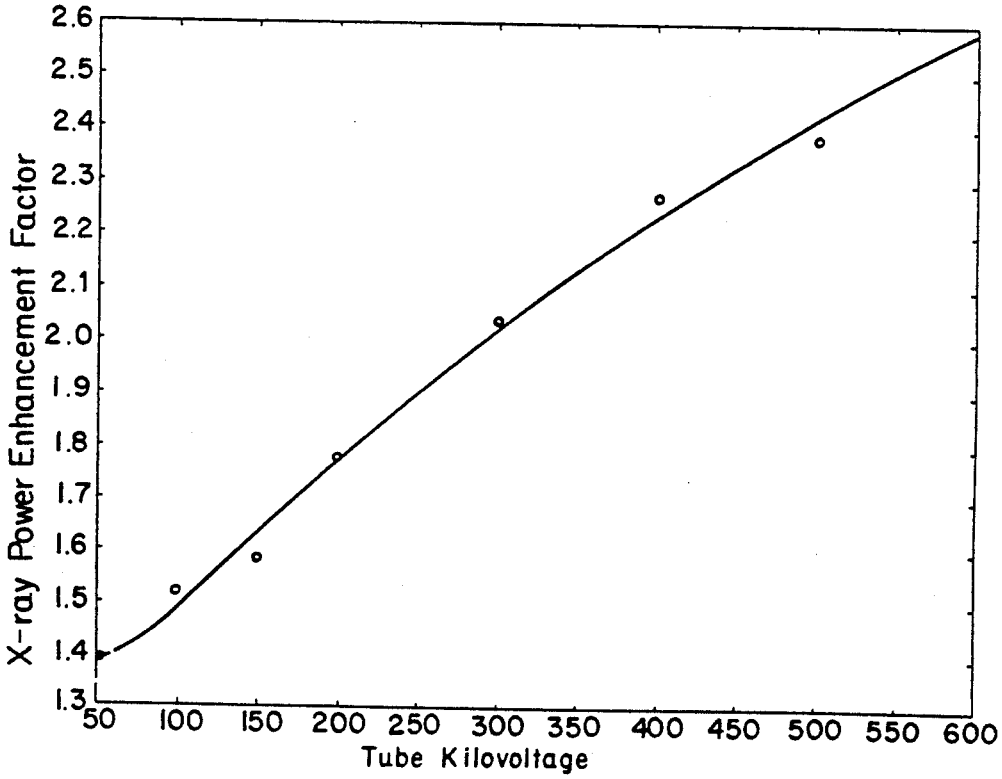
FIG. 5 is a plot of the ratio of the X-ray power produced by the tube of the present invention to the power produced by the tube of the prior art as a function of tube voltage FIG. 6 are plots of photon number distribution emitted from a target at approximately 10° as a function of photon energy for both a standard tube and the tube of the present invention.

The X-ray power enhancement factor of the tube of the present invention over standard tubes is plotted as a function of tube kilovolts in FIG. 5. The enhancement is quite apparent from the curve. The enhancement ranges from 1.4 at 50 kilovolts to about 2.4 at 550 kilovolts with particular emphasis at 150 kV where the enhancement is 1.55.

The next matter to be considered is target heat load which is essentially equal to the electron deposition energy $E_D$. The heat load ratio H is defined $$H=[E_D]_{EP}/[E_D]_S. \quad (4)$$

for the same X-ray emission energy such that $[E_X(\Theta=10°)]\alpha=10°$ is equal to $[E_X(\Theta=80°)]\alpha=80°$, H=1P where P is the power enhancement factor. As an example, at 150 keV, FIG. 5 indicates H=1/1.6=0.63. Thus at 150 keV the heating of the anode or target of the tube of the present invention is only 0.63 times that of a conventional tube.

The target heat load fractions from FIG. 4 are for $\alpha=10°$ and $\alpha=80°$, equal to 0.31 and 0.62 respectively. Thus for the same heat load on the target $I_{EP}\approx2I_S$ over the region from 50 keV to 500 keV. Specifically the target of the tube of the present invention can accommodate about twice the electron beam current as a standard tube for the same heating effect.

Considering the ratio of currents required to produce the same X-ray emission we have $$F_S/F_{EP}=(E_T]_{EP}[E_{TS})\ ([E_D]_S/[E_D]_{EP})\approx2 \quad (5)$$

and from Equations 1 and 2

$$r_s/r_{EP}=1/P=[E_D]_{ED}/[E_D]S \quad (6)$$

Thus $$I_{EP}\approx2I_2/P \quad (7)$$

For 150 KV, where P=1.6, $I_{EP}=1.3I_S$. Therefore to produce the same X-ray emission energy at an $\alpha=10°$, the current must be 1.3 times the current required to produce the same energy from a conventional tube. Since, however, with an angle $\alpha=10°$ the current required to produce the same heat in the anode as an angle $\alpha=80°$, the current in the tube of the present invention may be increased by 1.3 times and still produce considerably less heating of the target than the conventional tube or the X-ray emission energy may be greatly increased ($I_{EP}\approx2I_I$) with no increase in heating of the target.

Figure 6:
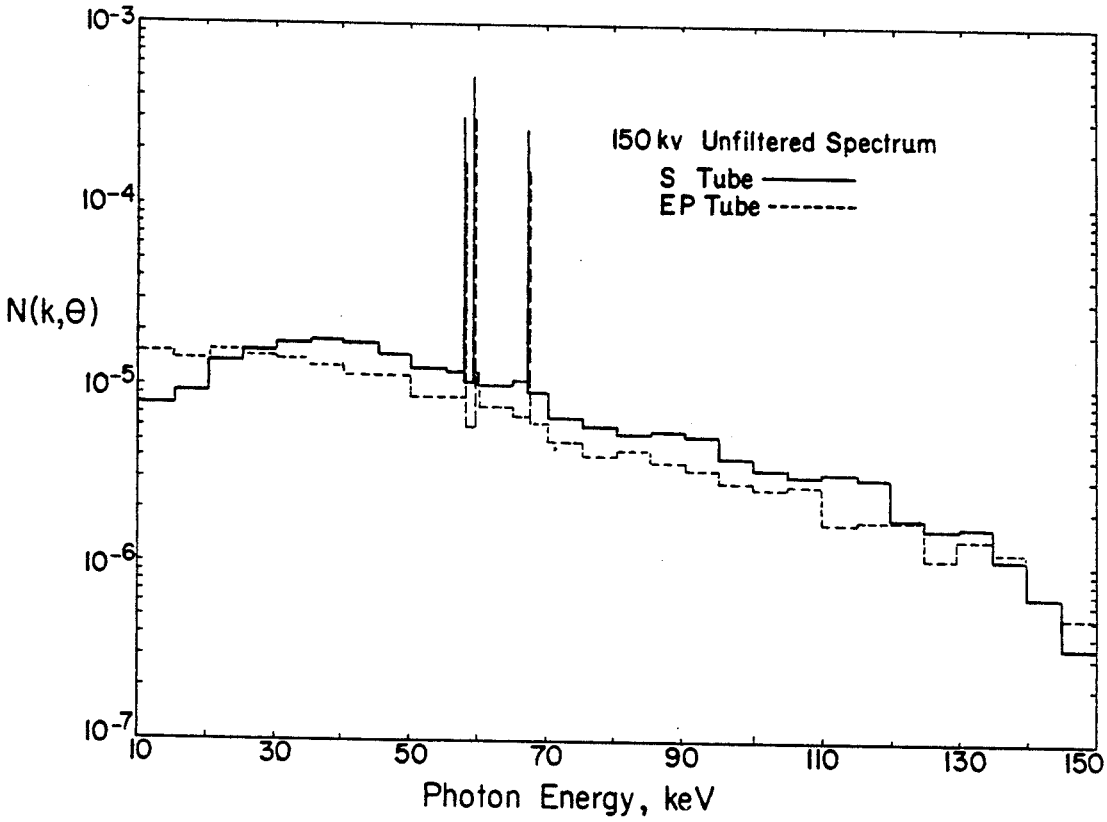

A direct comparison of the photon number distribution of the present tube and of a standard tube at 150 kV excited by the same beam currents is provided by FIG. 6. This graph plots the factor N(k,Θ) of both tubes against photon energy in keV. The factor N(k,Θ) is the photon number distribution emitted with dependence on k (photon energy) per unit energy interval (averaged over 5 keV intervals (2 keV at 50 kV)) and Θ averaged over 5 to 10°, and $\phi$ averaged over −10° to +10°, per unit solid angle per incident electron for a given T and angle $\alpha$.

As indicated above the N(k,Θ) for a standard tube is greater for the same electron beam current than for the tube of the present invention but at a current of 1.3 times the standard tube beam current the factor N(k,Θ) are equal and at equal anode heating the factor N(k,Θ) for the tube of the present invention is far greater, particularly in the high energy region.

The following table provides a numerical comparison of various factors of the standard and enhanced power tubes.

Comparison of the Enhanced Power (EP) and the Standard (S) X-Ray Tubes

| | Standard Tube | Enhanced Power Tube |
|---|---|---|
| 1. Geometry | | |
| a. X-Ray emission angle, Θ | 10° | 10° |
| b. Incident electron angle, $\alpha$ | 80° | 10° |
| c. Azimuthal angle, $\phi$ | 0° | 0° |
| 2. X-Ray Power Enhancement Factor (EP Tube/S Tube): same target heat load | | |
| a. 50 kV | 1.0 | 1.4 |
| b. 150 kV | 1.0 | 1.6 |
| c. 300 kV | 1.0 | 2.0 |
| d. 500 kV | 1.0 | 2.4 |
| 3. Target Heat Load Ratio (EP Tube/S Tube): same X-Ray emission power | | |
| a. 50 kV | 1.0 | 0.71 |
| b. 150 kV | 1.0 | 0.63 |
| c. 300 kV | 1.0 | 0.50 |
| d. 500 kV | 1.0 | 0.42 |
| 4. Tube Current Ratio (EP Tube/S Tube) | | |
| a. Same target heat load | 1.0 | 2.00 |

-continued

| Comparison of the Enhanced Power (EP) and the Standard (S) X-Ray Tubes | | |
|---|---|---|
| | Standard Tube | Enhanced Power Tube |
| b. Same X-Ray emission power | | |
| 50 kV | 1.0 | 1.42 |
| 100 kV | 1.0 | 1.26 |
| 300 kV | 1.0 | 1.00 |
| 500 kV | 1.0 | .82 |

Figure 7:
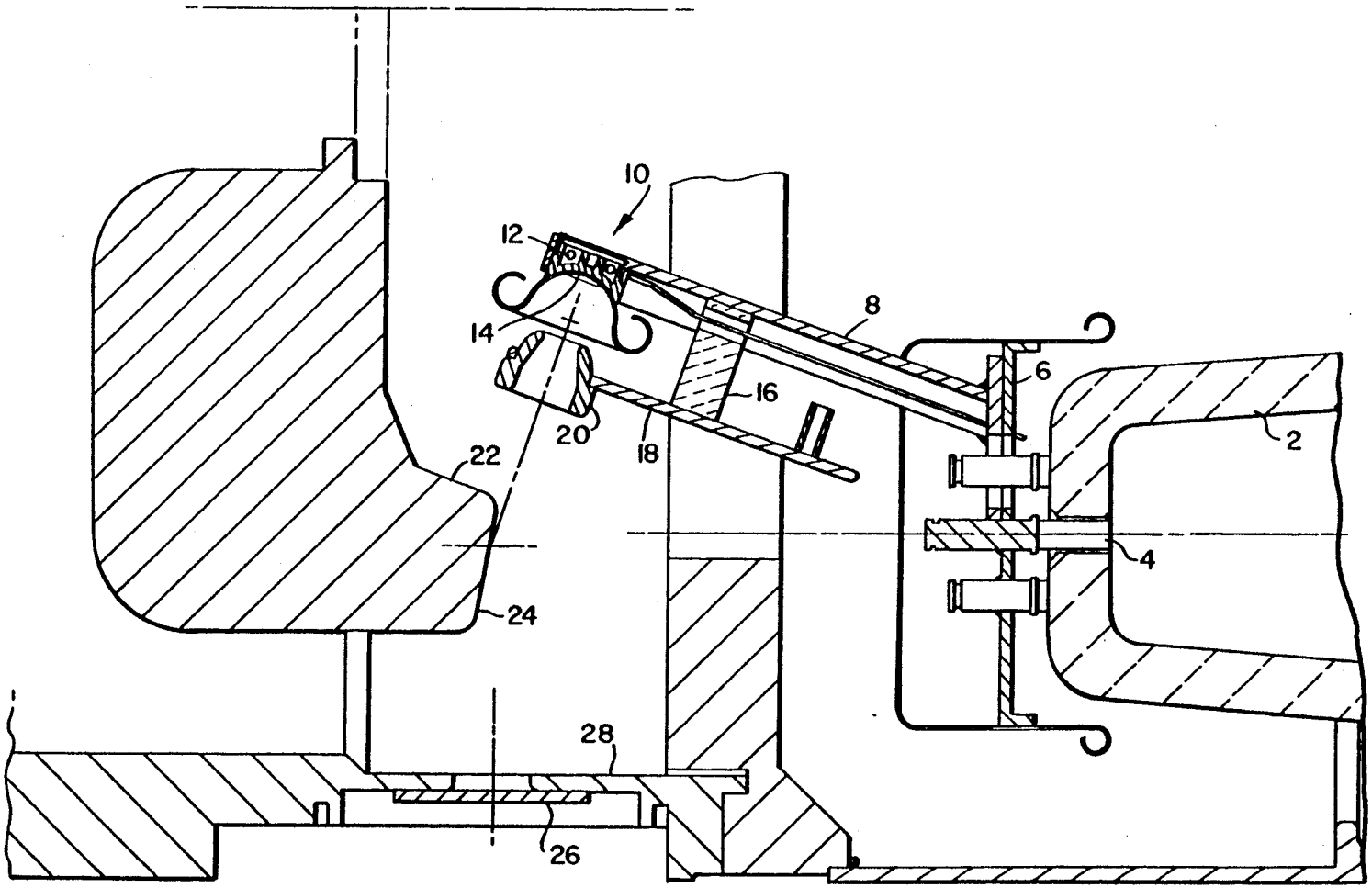
FIG. 7 illustrates in section an X-ray tube designed in accordance with the present invention.

A tube in accordance with the present invention is illustrated in FIG. 7 of the accompanying drawings. The tube illustrated is a 150 kV employed in CT systems. A cathode feed-through ceramic 2, accommodates a cathode feedthrough 4 and supports a member 6 from which an arm 8 extends. The arm 8 at its end remote from support 6 has secured thereto the cathode structure 10 comprising a heater 12 and a dispenser cathode 14. The radius of the dispenser cathode is 0.2 inch and the drawing is drawn to scale. A ceramic support 16 is secured at one end onto the arm 8 and supports at its other end an arm 18 on which is supported focusing electrode 20 axially aligned with the cathode 14.

The stream of electrons emitted by the cathode 14 is aimed at a tungsten target or anode 22 at an angle of 10° to the target surface 24 of the target. A beryllium window 26 is formed in a sidewall 28 of the tube to permit exit of X-rays emitted from the target at an angle $\Theta$ of 5°-15°, 10° along the centerline of the emissions. The angle $\phi$ in the other plane of the beam covers $-10°$ to $+10°$ from its centerline thus providing a solid angle of suitable dimensions.

The focusing electrode has been changed from that in conventional tubes so as to reduce the focusing effect of the electrode to achieve focus of the electron beam at the target. Also preliminary results indicate the focusing is such that increases in current do not produce blooming of the beam If required further focusing electrodes (not shown in FIG. 7) can be inserted in the presently unoccupied drift space. It was found that in the present case such a second focusing electrode was not needed.

Figure 8:
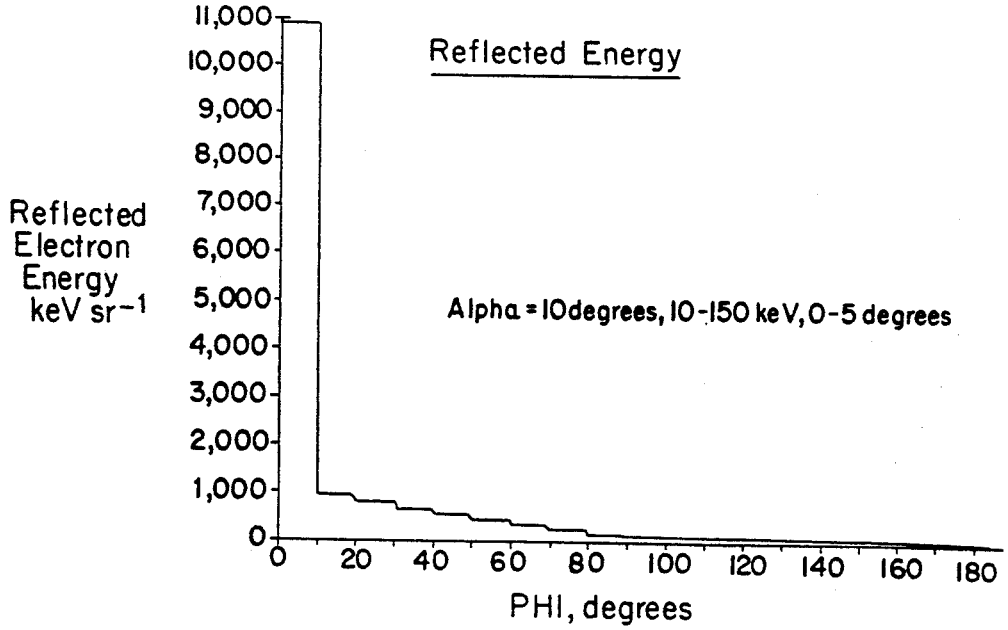
FIG. 8 is a plot of the distribution of reflected electron energy as a function of the angle $\phi$.

As previously indicated scattered electrons can produce serious heating problems in the tube. Referring now specifically to FIG. 8 of the accompanying drawings there is illustrated a plot of scattered electron energy as a function of the angle $\phi$. It is readily apparent that at an angle $\phi$ of 10° there is a dramatic drop in the electron energy reflected off of the anode as the angle $\phi$ is varied. Thus if other means to remove these electrons from the photon stream are not available, the window is located at an angle of 15° to 20° out of line with the electron beam; this angle being illustrated by the dashed line 33 in FIG. 1. The angle is selected as 15° or 20° depending upon the width of the window, i.e. whether it accepts a photon stream of a width of 10° or 20° about the center line of the stream $\phi = -5°$ to $+5°$ or $-10°$ to $+10°$.

Figure 9A:
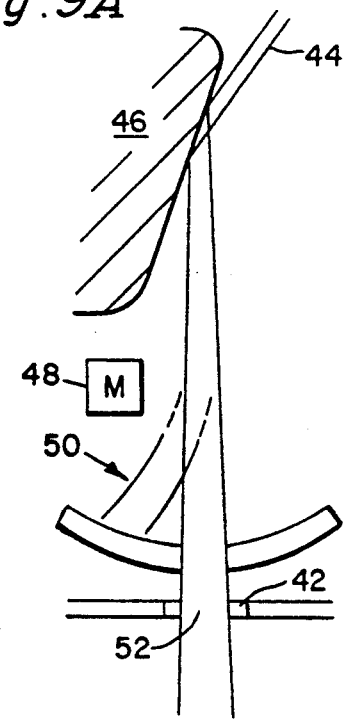
FIG. 9A illustrates the use of a magnet to deflect scattered electrons and a shield to absorb them.

If the distance from the target to the window is large then the structure of FIG. 9 may be employed. The electron beam 44 impinges tungsten target 40. A stream of scattered electrons as well as the photons progress along a path toward window 42. A magnet 48 is located between the anode or target 46 and the window 52 so as to deflect electrons 50 in the photon stream out of the path to the window. If a metal envelope is employed for the tube, it can be employed to capture the electrons and the tube air or water cooled. If a glass envelope is employed, an electron absorbing shield which may be copper or other high conductivity material with a high enough melting temperature forms a shield with an opening area aligned with the path to the window of the photons. This shield is not only used to absorb the electrons deflected by the magnet 48 but all other scattered electrons not along the path to the window. As previously indicated if these electrons are not absorbed they may well be reflected back to the anode increasing its heating by about 10% and if a glass tube is employed the glass may be heated by direct impingement to melting temperatures.

Figure 9B:
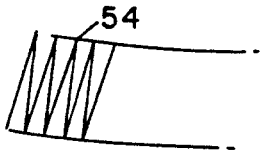
FIG. 9B is a detail of the shield of FIG. 9A.

The shield is illustrated in FIG. 9B and comprises a series of saw-teeth 54 having an angle of about 30° or less between the sharp ends of the teeth facing the anode 46. At angle of 30° or less the electrons hit the wall of a tooth and continue down into the region between the teeth with repeated deflections into the depths between the teeth. An original value of about 70% of the electrons being deflected back to the anode is reduced to about 10% or less. By decreasing the saw-tooth angle to below 30° the amount of reflected electrons is decreased and thus one may approach zero albedo.

The choice of the values of the angle is determined by heat conduction and geometrical considerations in the manner well known to the practitioners. To wit: decreasing the angle decreases the albedo but increases the path length for the heat flow and increases the space needed to accommodate the trap.

Figure 10:
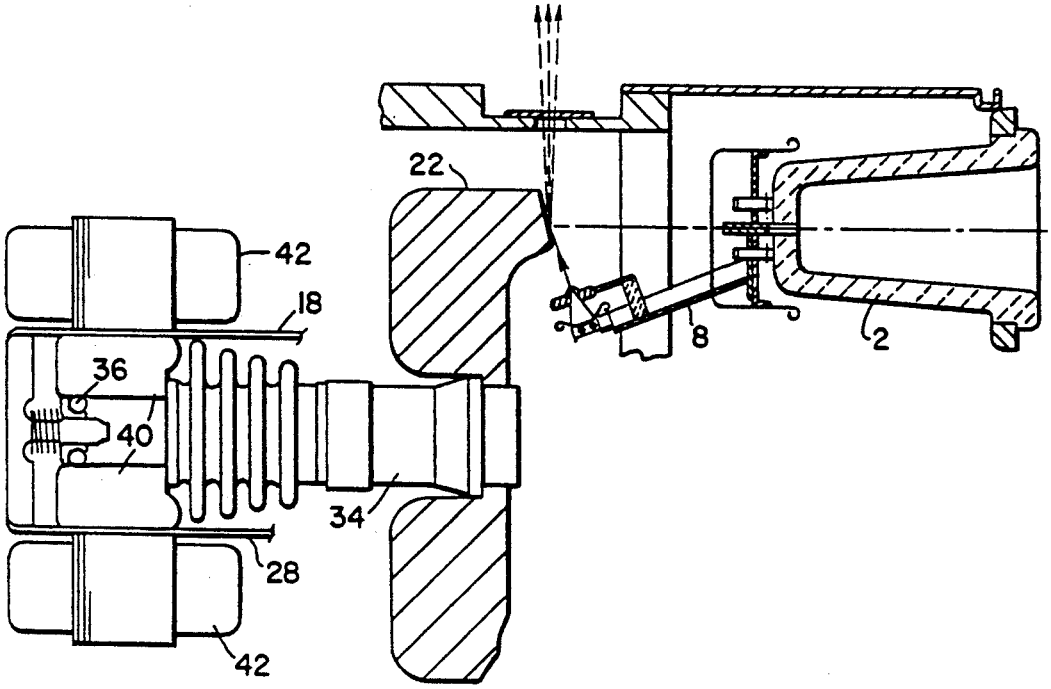
FIG. 10 illustrates the tube of the present invention modified to employ a rotating anode.

The anode 22 may be a rotating anode or a stationary anode. Referring to FIG. 10 of the accompanying drawings, a rotating anode 22 is mounted on a shaft 34 supported at its two ends by bearings 36 and 38. At the end of the shaft 34 supported by bearing 36, there is secured to the shaft an armature 40. The armature 40 is located within the tube housing 28 which is vacuum sealed. The armature 40 is part of an electric motor having its field coils 42 located external to the housing and magnetically coupled to armature 40 through the non-conductive, non-magnetic housing 28. Thus the anode-target 22 is rotated at a speed determined basically by the design criteria of the tube.

Figure 11:
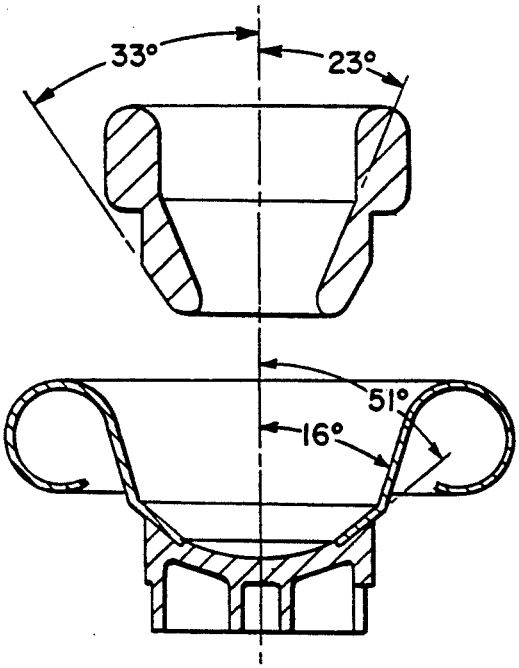
FIG. 11 is a dimensional scale drawing of the cathode and focusing electrode assembly employed in the X-ray tube of the present invention at 150 kV.

Referring to FIG. 11 of the accompanying drawings there is illustrated a dimensional scale drawing of the cathode and focusing electrodes employed in the present invention. This drawing is included to meet the best mode requirements but will form the subject of a joint application of which the present inventor is one of the inventors.

The distance from the cathode to the target or anode is approximately 1.08 inch. The dimensions are for a 150 kV tube and are of a preliminary design.

Many variations and modifications of the above-described embodiments are within the ordinary skill of the skilled artisan in this art, without departing from the scope of the invention. Accordingly, those modifications and embodiments are intended to fall within the scope of the invention as defined by the following claims.

What is claimed is:

1. The method of increasing the X-ray emission power of an X-ray tube for the same X-ray emission geometry and target heat load as used in present-day X-ray tubes comprising the steps of forming a beam of electrons, aiming the beam of electrons at an X-ray producing target at an angle to the surface of the target determined by the Monte Carlo formula to produce the maximum X-ray beam power per unit of heat deposited in the target, focusing the beam of electrons to a focal spot on the target surface, with the same size and uniformity as obtained with an incident electron beam angle to anode of 80°, utilizing the photons emitted from the target at an angle of elevation of approximately 7° to 13° to the surface of the target.

2. The method according to claim 1 further comprising providing a window for the X-ray tube having its centerline lying at an azimuthal angle to the path of the electron beam in the range of 0° to approximately 20°.

3. The method according to claim 2 further comprising deflecting electrons out of the path of the photons.

4. The method according to claim 3 further comprising capturing electrons scattered by the target to prevent a substantial portion of the electrons from being scattered back to the target.

5. The method according to claim 4 further comprising placing a shield between the tube wall and the target at an appropriate azimuthal angle with respect to the target window direction to capture electrons out of alignment with the window.

6. The method according to claim 5 further comprising forming the shield with a series of saw-teeth facing the target with an angle between adjacent surfaces of said saw-teeth equal to or less than approximately 30°.

7. The method according to claim 2 further comprising providing a window at an angle Θ of less than the angle of scattering of a majority of the electrons from the target wherein 8 is the angle between the surface of the target and the center of the window perpendicular to the surface of the target.

8. The method according to claim 5 comprising locating an opening in the shield permitting photons to proceed through the window.

9. The method according to claim 1 comprising rotating the target whereby to change from moment to moment the area of the target subject to the electron beam.

10. An X-ray tube comprising a source of electrons, a target having a surface for producing photons upon bombardment by electrons, means for focusing a beam of electrons from said source of electrons on said target at an angle determined by the Monte Carlo formula to produce the maximum X-ray power per unit of heat developed in the target, a window for passing photons emitted by said target, said window located at an angle to the surface of said target of approximately 7° to 13°.

11. An X-ray tube according to claim 10 wherein said window for the photons lies at an azimuthal angle of 0° to 20° relative to the path of said beam of electrons.

12. An X-ray tube according to claim 11 wherein said azimuthal angle falls within a range of from −10° to +10° about the centerline of said photons selected by placement of the center of said window.

13. An X-ray tube according to claim 12 wherein said azimuthal angle falls within a range of from −5° to +5° about the centerline of said photons selected by placement of the center of said window.

14. An X-ray tube according to claim 10 further comprising means for deflecting scattered electrons out of the stream of photons emitted by said target.

15. An X-ray tube according to claim 10 or claim 14 further comprising means for capturing electrons scattered from said target.

16. An X-ray tube according to claim 15 wherein said means for capturing comprises a trap having saw-teeth facing said target, said saw-teeth having an angle between adjacent surfaces of said saw-teeth equal to or less than 30°.

17. An X-ray tube according to claim 15 and or claim 16 wherein said trap has an opening in alignment with and of a size to permit photons to pass through approximately the entire area of said windows.

18. An X-ray tube according to claim 10 further comprising means for preventing material heating of said target by electrons deflected from said target.

19. An X-ray tube according to claim 18 wherein said means for preventing includes preventing said deflected electrons from being back-scattered toward said target.

20. An X-ray tube according to claim 10 wherein the center of said window lies at an angle of 15° to the centerline of the beam of electrons.

21. An X-ray tube according to claim 20 wherein said window defines an azimuthal angle of the stream of photons that is 10° wide at a given azimuthal angle of +10° to −10° to the surface of said target relative to the centerline of said stream of photons.

22. An X-ray tube according to claim 10 wherein said window lies at an angle of 20° to the centerline of the beam of electrons.

23. An X-ray tube according to claim 22 wherein said window defines an azimuthal angle of the stream of photons that is 20° wide parallel to the relative to the centerline of said stream of photons at a given azimuthal angle of +10° to −10°.

24. The method of increasing the X-ray emission power and enhancing the higher energy region of an unfiltered X-ray spectrum such that the distribution of X-ray intensities over the high energy region of the continuous spectrum, 50 to 100% of the incident electron energy, relative to the energy below the high energy region of an X-ray tube for the same X-ray emission geometry and target heat load is greater than the corresponding X-ray intensities for an X-ray tue in which the incident electron beam angle is in the region of 80° comprising the steps of forming a beam of electrons, aiming the beam of electrons at an X-ray producing target at an angle to the surface of the target determined by the Monte Carlo formula to produce the maximum X-ray power per unit of heat developed in the target, focusing the beam of electrons to a focal spot on the target surface, with the same size and uniformity as obtained with an incident electron anode of 80°, utilizing the photons emitted form the target at an angle of elevation of approximately 7° to 13° to the surface of the target.

25. The method according to claim 1 wherein said angle is approximately 10°.

26. The method according to claim 1 or claim 2 further comprising rotating said target.

27. An X-ray tube according to claim 10 or claim 24 further comprising means for rotating said anode.

28. The method of increasing the X-ray emission power of an X-ray tube for the same X-ray emission geometry and target heat load as used in present-day X-ray tubes comprising the steps of forming a beam of low energy electrons of a voltage below 300 keV, aiming the beam of electrons at an X-ray producing target at an angle to the surface of the target determined by the Monte Carlo formula to produce the maximum X-ray beam power per unit of heat deposited in the target, focusing the beam of electrons to a focal spot on the target surface, with the same size and uniformity as obtained with an incident electron beam angle to anode of 80°, utilizing the photons emitted from the target at an angle of elevation of approximately 7° to 13° to the surface of the target.

29. An X-ray tube comprising a source of low energy electrons below 300 keV, a target having a surface for producing photons upon bombardment by electrons, means for focusing a beam of electrons from said source of electrons on said target at an angle determined by the Monte Carlo formula to produce the maximum X-ray power per unit of heat developed in the target, a window for passing photons emitted by said target, said window located at an angle to the surface of said target of approximately 7° to 13°.

30. The method of increasing the X-ray emission power and enhancing the higher energy region of an unfiltered X-ray spectrum such that the distribution of X-ray intensities over the high energy region of the continuous spectrum, 50 to 100% of the incident electron energy, relative to the energy below the high energy region of an X-ray tube for the same X-ray emission geometry and target heat load is greater than the corresponding X-ray intensities for an X-ray tube in which the incident electron beam angle is in the region of 80° comprising the steps of forming a low energy beam of electrons below 300 keV, aiming the beam of electrons at an X-ray producing target at an angle to the surface of the target determined by the Monte Carlo formula to produce the maximum X-ray power per unit of heat developed in the target, focusing the beam of electrons to a focal spot on the target surface, with the same size and uniformity as obtained with an incident electron anode of 80°, utilizing the photons emitted from the target at an angle of elevation of approximately 3° to 13° to the surface of the target.

* * * * *